US007743480B2

(12) United States Patent
Park et al.

(10) Patent No.: US 7,743,480 B2
(45) Date of Patent: Jun. 29, 2010

(54) METHOD OF MANUFACTURING A DRUM-TYPE WASHING MACHINE

(75) Inventors: Sam Je Park, Gimhae-si (KR); Kwang Soo Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 12/289,335

(22) Filed: Oct. 24, 2008

(65) Prior Publication Data

US 2009/0064729 A1 Mar. 12, 2009

Related U.S. Application Data

(62) Division of application No. 10/885,082, filed on Jul. 7, 2004, now Pat. No. 7,451,626.

(30) Foreign Application Priority Data

| | | |
|---|---|---|
| Jul. 8, 2003 | (KR) | 10-2003-0046021 |
| Jul. 8, 2003 | (KR) | 10-2003-0046027 |
| Jul. 8, 2003 | (KR) | 10-2003-0046028 |
| Aug. 26, 2003 | (KR) | 10-2003-0059147 |

(51) Int. Cl.

| | |
|---|---|
| ***B21D 39/02*** | (2006.01) |
| ***B23P 11/00*** | (2006.01) |
| ***D06F 37/02*** | (2006.01) |

(52) U.S. Cl. ..... 29/505; 29/509; 29/525.14; 403/282; 68/24; 68/142

(58) Field of Classification Search ..... 29/505, 29/509, 525.01, 525.14; 68/24, 142; 228/137; 72/368, 379.2, 379.4; 403/282, 284
See application file for complete search history.

(56) References Cited

U.S. PATENT DOCUMENTS

| | | | | |
|---|---|---|---|---|
| 332,160 | A | 12/1885 | Janke et al. | |
| 1,472,434 | A | 10/1923 | Oberg | |
| 1,719,336 | A | 7/1929 | McDonald | |
| 1,826,236 | A | 10/1931 | Behan | |
| 1,888,413 | A * | 11/1932 | Sebell | 29/458 |
| 2,255,802 | A * | 9/1941 | Murch | 220/680 |
| 2,317,213 | A | 4/1943 | Oliver | |
| 3,006,176 | A | 10/1961 | Behrens | |
| 5,513,767 | A * | 5/1996 | Daehn | 220/89.2 |
| 5,746,070 | A | 5/1998 | Bailey et al. | |
| 6,401,363 | B1 * | 6/2002 | Miramondi | 34/602 |

FOREIGN PATENT DOCUMENTS

| | | |
|---|---|---|
| CN | 1190141 | 8/1998 |

(Continued)

*Primary Examiner*—Jermie E Cozart
(74) *Attorney, Agent, or Firm*—McKenna Long & Aldridge LLP

(57) ABSTRACT

Disclosed is a drum-type washing machine having a tub provided therein for storing wash water with an improved structure, the tub including a center tub formed in a hollow cylindrical form for rotatably providing a drum therein; and a back tub including a base plate for covering a rear side of the center tub, a first bending part bent backward from an outline of the base plate, and overlapped on an inner surface of the center tub, and a second bending part bent frontward from the first bending part, and overlapped on an outer circumferential surface of the center tub.

3 Claims, 15 Drawing Sheets

FOREIGN PATENT DOCUMENTS

| | | |
|---|---|---|
| CN | 1190141 A | 8/1998 |
| DE | 1 460 836 | 4/1969 |
| DE | 1460836 | 4/1969 |
| DE | 2 719 336 | 11/1978 |
| DE | 3041506 | 6/1982 |
| DE | 29710704 | 10/1997 |
| EP | 0 201 125 | 11/1986 |
| EP | 0 210 143 | 2/1987 |
| EP | 0 405 068 | 1/1991 |
| FR | 1 168 135 | 12/1958 |
| GB | 345862 | 8/1956 |
| GB | 1 520 660 | 12/1975 |
| GB | 1 568 045 | 5/1980 |
| GB | 2 069 649 | 10/1982 |
| GB | 2 096 649 | 10/1982 |
| JP | 3-041506 | 2/1991 |
| JP | 6-054988 | 3/1994 |
| JP | 10-080595 | 3/1998 |
| JP | 10-263268 | 10/1998 |
| JP | 10-272288 | 10/1998 |
| JP | 11-070292 | 3/1999 |
| JP | 11-147147 | 6/1999 |
| JP | 11-207077 | 8/1999 |
| KR | 20-1992-12151 | 7/1992 |

* cited by examiner

METHOD OF MANUFACTURING A DRUM-TYPE WASHING MACHINE

CROSS-REFERENCE TO RELATED APPLICATIONS

This application is a divisional application of U.S. patent application Ser. No. 10,885,082 filed Jul. 7, 2004, now U.S. Pat. No. 7,451,626 B2 claims the benefit of Korean Application Nos. P2003-46021 filed on Jul. 8, 2003, P2003-46027 filed on Jul. 8, 2003, P2003-46028 filed on Jul. 8, 2003 and P2003-59147 filed on Aug. 28, 2003, each of which are hereby incorporated by reference as if fully set forth herein.

BACKGROUND OF THE INVENTION

1. Field of the Invention

The present invention relates to a drum-type washing machine, and more particularly, to a drum-type washing machine with a tub having an improved structure.

2. Discussion of the Related Art

In general, laundering using a drum-type washing machine is carried out using a frictional force between wash water and laundry that receives the driving force of a motor to perform washing. Such a method causes little damage to the laundry, prevents the laundry from getting tangled, and achieves such washing effects as beating and rubbing.

FIG. 1 illustrates a perspective view of an exterior of a general drum-type washing machine, and FIG. 2 illustrates a cross-sectional view of a drum-type washing machine in accordance with a related art.

As illustrated in FIG. 1, an opening 1*a* opened or closed by a door 8 is provided on a front surface of an outer case 1, and a drum 3 is rotatably provided therein for receiving laundry. On a surface of the drum 3, a plurality of holes through which the wash water passes is provided.

As illustrated in FIG. 2, on an outside of the drum 3, a tub 2 is provided for storing the wash water, and the tub 2 is coupled with a damper 10 and a spring 12 so as to be fixed to an outer case 1. On a central part of the door 8, a door glass 8*a* depressed inward of the drum-type washing machine is provided, and a gasket 7 is provided between the door 8 and the tub 2 for preventing the wash water from leaking. On a rear side of the tub 2, a motor 6 is provided for rotating the drum 3, and washing is performed by rotation of the drum.

FIG. 3 illustrates a cross-sectional view of a structure of a bearing housing on a rear side of the tub in accordance with the related art, and FIG. 4 illustrates a perspective view showing a rear side of the tub, and FIG. 5 illustrates a cross-sectional view of a rear side of the tub.

As illustrated in FIG. 3, a bearing housing 4 is provided on the rear side of the tub 2. On the central part of the bearing housing 4, a hole through which a rotating axis 6*c* of a motor 6 is provided, and a bearing securing smooth rotation of the rotating axis is provided.

Meanwhile, the motor 6 includes a rotor 6*a* and a stator 6*b*, and the stator 6*b* is fixed to the bearing housing 4. When power is supplied to the motor 6, the rotating axis 6*c* is rotated together with the rotor 6*a*. Therefore, the drum 5 coupled to an end of the rotating axis 6*c* is rotated and the washing is performed in the drum-type washing machine.

As illustrated in FIG. 4, the bearing housing 4 includes a hub 4*a* and a plurality of bridges 4*b*. The plurality of bridges 4*b* is extended in three directions at intervals of 120 degrees along a circumference of the hub 4*a*. In this case, on an upper part thereof, a carrying bolt 5 is coupled with an end of the bridge 4*b*. The carrying bolt 5 fixes the tub 2 to the outer case 1. Accordingly, the tub 2 is prevented from hitting against the outer case 1 during transportation of the drum-type washing machine.

For preventing weight of the outer case 1 is centered on a side thereof through the carrying bolt 5, a supplementary member 18 is inserted between the carrying bolt 5 and the outer case 1.

Referring to FIG. 3, a fixing bracket 9 is provided at each end of the plurality of bridges 4*b*. A first end of the bracket 9 is fixed to a side of the tub 2, and a second end of the bracket 9 is coupled with an end of the bridges 4*b*.

In this case, a coupling hole to which a bolt 11 is coupled is provided at an end of the bridge 4*b*. Therefore, the bridge 4*b* is fixed to the bracket 9 by passing the bolt 11 through the bracket 9 and coupling to the coupling hole.

FIG. 5 illustrates a perspective view of a tub in accordance with a related art, and FIG. 6 illustrates a diagram showing a front side of an assembled structure of the tub.

As illustrated in FIG. 5, the tub 2 includes a center tub 21, a front tub 22, and a back tub 23. In this case, the center tub 21 is formed in a cylindrical form, and the back tub 23 covers a rear side of the center tub 21. A drum 3 is provided on an inner side of the tub 2, and an opening 2*a* is projected frontward from the front tub 22.

On a circumference of the front tub 22, a bending part 22*a* bent in a "U" form is provided, and a sealing member 25 is inserted to an inside of the bending part 22*a*. A curled end of the center tub is inserted into the bending part.

A plurality of fixing apparatus 24 formed in a buckle form is provided along an outer circumferential surface of the center tub 21. The fixing apparatus 24 includes a hanger 24*a*, and a lever 24*b*. When the hanger 24*a* is hanged on a circumference of the front tub 22 and the lever 24*b* is pulled, the front tub 22 is pulled toward the cent tub 21 and fixed thereto. In this instance, the sealing member 25 is compressed to seal the front tub 22 and the center tub 21.

Meanwhile, the abovementioned tub for the drum-type washing machine in accordance with the related art has problems as follows.

First, the tub and the bearing housing needs to be thick for preventing the tub and the bearing housing from being damaged because the bearing housing is fixed to the tub by the three bridges, and vibration and weight generated during a high speed rotation are centered on the tub and the bearing housing.

Second, for preventing the weight is centered on a side of the outer case through the carrying bolt, a separated supplementary member needs to be provided.

Third, for coupling the bridges of the bearing housing with the tub, separate brackets are needed. Since the first end of the bracket is welded on a side of the tub, and the second end thereof is coupled with the bridge, assembling is not easy.

Fourth, a coupling force of the fixing apparatus for coupling the front tub with the center tub is uneven along a circumferential direction.

Fifth, it is difficult to assemble the fixing apparatus on the outer circumference of the center tub, thereby decreasing productivity of the tub.

SUMMARY OF THE INVENTION

Accordingly, the present invention is directed to a drum-type washing machine that substantially obviates one or more problems due to limitations and disadvantages of the related art.

An object of the present invention is to provide a drum-type washing machine having an improved bearing housing and a tub for more stably operating the drum washing machine.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a drum-type washing machine having a tub provided therein for storing wash water, wherein the tub includes a center tub formed in a hollow cylindrical form for rotatably providing a drum therein; and a back tub including a base plate for covering a rear side of the center tub; a first bending part bent backward from an outline of the base plate, and overlapped on an inner surface of the center tub; and a second bending part bent frontward from the first bending part, and overlapped on an outer circumferential surface of the center tub.

In this case, the first bending part and the center tub are coupled by welding, the second bending part is bent to cover an end of the center tub by curling, and the first bending part and the second bending part are bent by a curling manufacturing. A pass through hole is provided at an overlapping part of the first bending part and the center tub.

In this case, the drum washing machine further includes a bearing housing including a hub provided at a rear side of the tub; and bridges having a coupling hole coupled with a bolt inserted into an end being radially extended from the hub through the pass through hole.

A guiding surface having a section depressed in a "V" form is provided in the vicinity of the pass through hole and the coupling hole, and a lower part of a head of the bolt is formed corresponding to the form of the guiding surface.

The second bending part is extended to a predetermined length along the first bending part and the center tub, and a pass through hole is provided at an overlapping part of the second bending part, the first bending part, and the center tub.

In this case, the drum washing machine further includes a bearing housing including a hub provided at a rear side of the tub; and bridges having a coupling hole coupled with a bolt inserted into an end being radially extended from the hub through the pass through hole.

A guiding surface having a section depressed in a "V" form is provided in the vicinity of the pass through hole and the coupling hole, and a lower part of a head of the bolt is formed corresponding to the form of the guiding surface.

Beads formed in a consecutive or inconsecutive bend form are provided on an outer circumferential surface of the center tub.

Meanwhile, in another aspect of the present invention, there is provided a drum-type washing machine having a tub provided therein for storing wash water, wherein the tub includes a base plate formed in a circular form, a back tub including a first bending part bent rearward form an outline of the base plate, and a center tub formed in a hollow cylindrical form, and having a rear inner circumferential surface overlapped with an outer circumferential surface of the first bending part, and having an end bent by a curl manufacturing for covering the end of the first bending part.

In another aspect of the present invention, there is provided a drum-type washing machine including a tub including a center tub formed in a hollow cylindrical form for having a drum rotatably provided therein, and a back tub including a bending part for covering a rear end of the center tub; and a bearing housing including a hub provided at a rear of the tub, and four bridges radially extended from the hub and fixed to the rear of the tub. In this case, the end of the bridge is coupled with the bending part by using the bolt. Two of the bridges are fixed to the tub to be symmetrical. Carrying bolts are coupled with the bridges fixed to the upper part of the tub.

Angles between the bridges are the same. When the lower part of the tub is formed in an oval form, the angles between the two bridges are not the same. A plurality of first beads is provided respectively at four points on a rear surface of the tub except a space in which the bridges are provided.

A plurality of second beads depressed frontward of the tub is provided on a rear surface of the tub for loading the tub and the bridges.

Meanwhile, in another aspect of the present invention, a method of manufacturing the drum-type washing machine includes the steps of forming a center tub formed in a circular form; forming a back tub including a first bending part by a curl manufacturing on an outline of a base plate formed in an oval form; inserting the back tub to overlap a rear inner circumferential surface of the center tub with the first bending part; seam welding the center tub with a side of the first bending part; and forming a second bending part for covering an end of the center tub by curling the first bending part.

In this case, the center tub formed in the cylindrical form is formed by rolling a metal sheet into a cylindrical form, and carrying out a butt welding to a seam. The method of manufacturing the drum-type washing machine further includes the step of forming beads, formed in a bend form, on an outer circumferential surface of the center tub by compressing with a roller in a state that a press is installed on an inside thereof.

In another aspect of the present invention, there is provided a drum-type washing machine including a center tub formed in a hollow cylindrical form, and a front tub provided in front of the center tub, the washing machine including a third bending part and a fourth bending part bent outward from a location at which the front tub and the center tub face each other; a sealing member provided between the third bending part and the fourth bending part; and a clamping means provided along an outer circumferential surface of the third bending part and the fourth bending part.

In this case, the clamping means is a bend covering the third bending part and the fourth bending part for pressing the sealing member. The bend is shorter than the length of the outer circumference of the bending parts, and has a side formed in an opening ring form.

A tightening means is provided at the opened part for applying tightening force tightening the bend in a circumferential direction. The tightening means includes a plurality of fixing plates projected to be perpendicular to the circumferential direction at a first side and a second side of the opened part of the bend; a bolt coupled through holes formed at the fixing plates; and a nut coupled with the bolt for applying force to tighten the bend.

A section of the bend is formed in a channel form. A section of the bend is formed in a "U" form. A section of the sealing member is formed in a "T" form. An end of the third bending part is curled frontward, and an end of the fourth bending part is curled rearward.

Both the ends of the third bending part and the fourth bending part are curled frontward. In this case, the sealing member is provided in a "U," form along the third bending part, and an extension extended from a side of the sealing member and being in contact with the fourth bending part is provided.

In another aspect of the present invention, there is provided a drum-type washing machine including a tub provided therein for storing wash water, wherein the tub includes a center tub having a third bending part bent outward at a front side thereof, and formed in a hollow cylindrical form; a back tub including a base plate for covering a rear of the center tub, a first bending part bent rearward from an outline of the base plate, and overlapped on an inner circumferential surface of the rear center tub, and a second bending part bent frontward from the first bending part, and overlapped with an outer circumferential surface of the center tub; a front tub having a fourth bending part bent to face the third bending part, and provided in front of the center tub; a sealing member provided between the third bending part and the fourth bending part; and a clamping means provided along outer circumferential surfaces of the third bending part and the forth bending part.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Hereinafter, referring to FIG. 7 to FIG. 14, a drum-type washing machine will be described in detail in accordance with each embodiment of the present invention.

Figure 1:
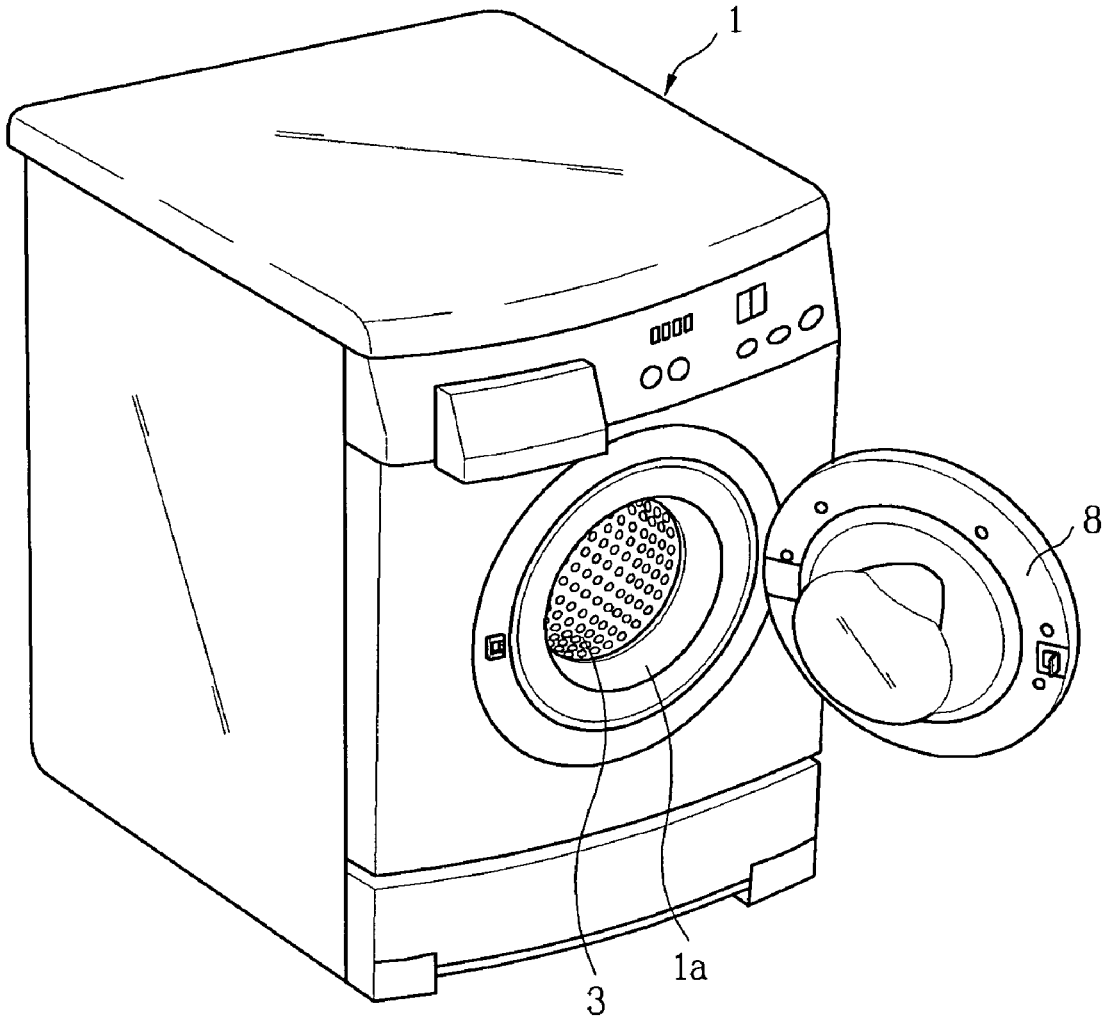
FIG. 1 Related Art
FIG. 1 illustrates a perspective view of a general drum-type washing machine.
Figure 2:
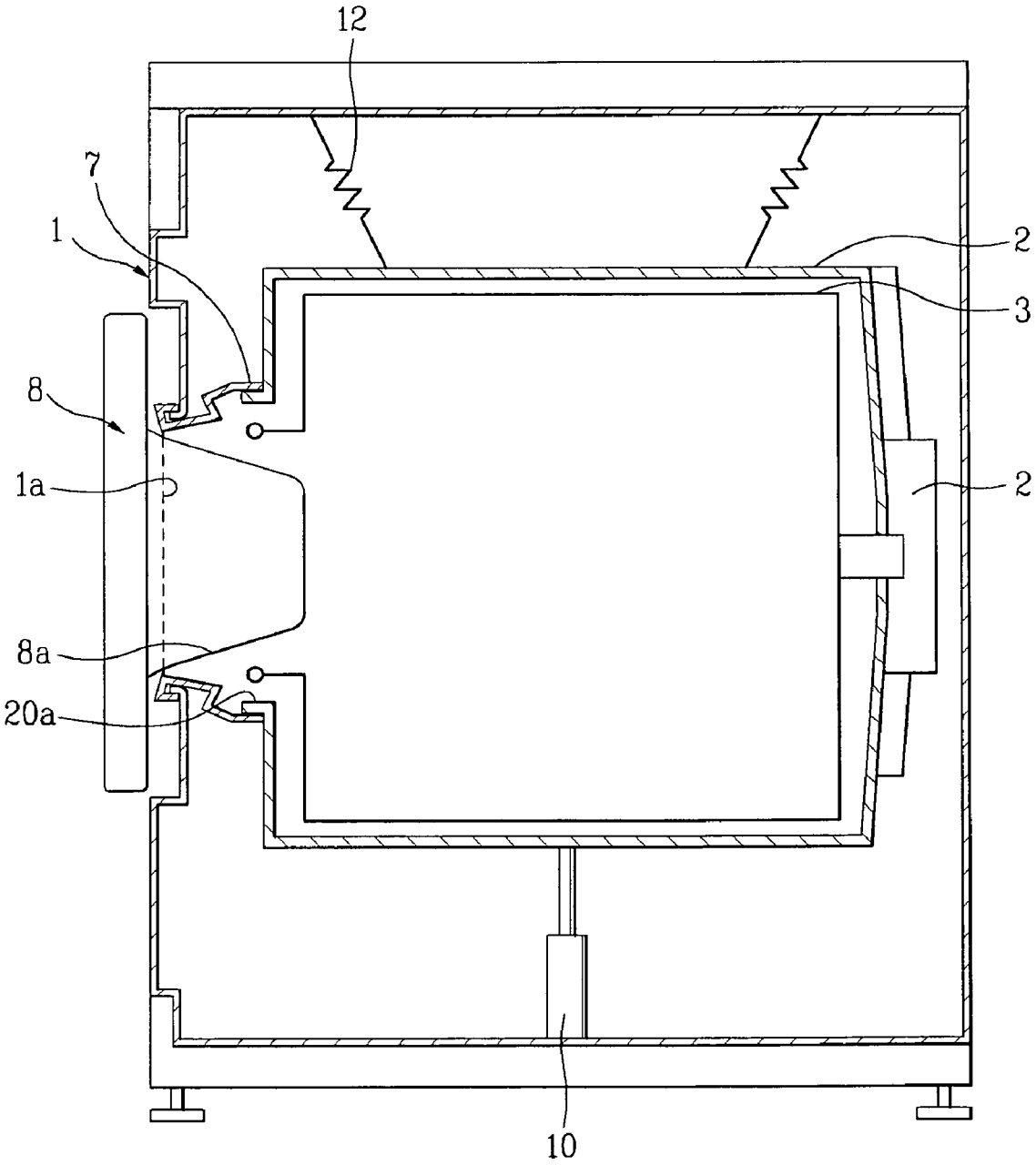
FIG. 2 Related Art
FIG. 2 illustrates a cross-sectional view of a drum washing machine in accordance with a related art.
Figure 3:
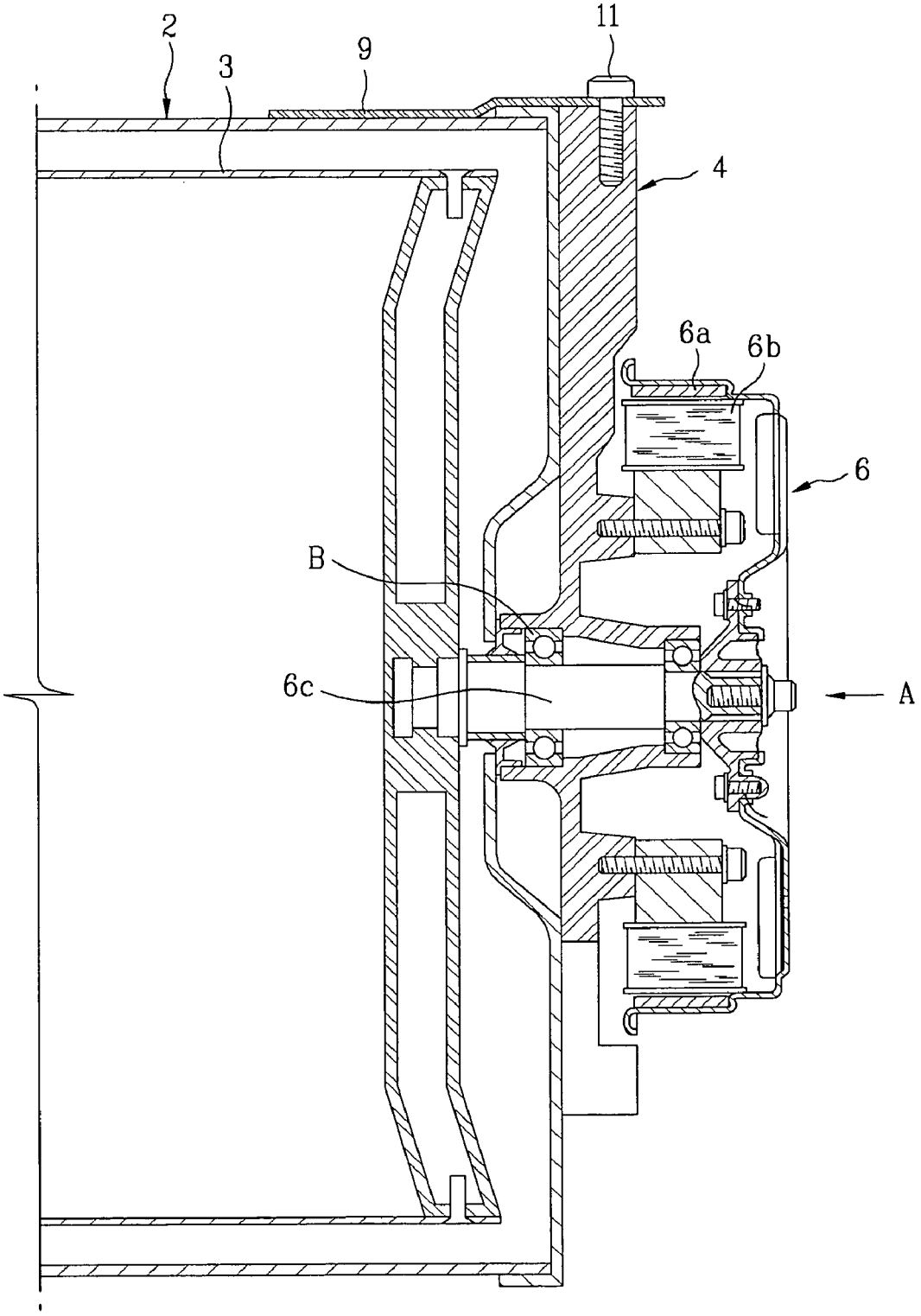
FIG. 3 Related Art
FIG. 3 illustrates a cross-sectional view showing a structure of a bearing housing in accordance with a related art.
Figure 4:
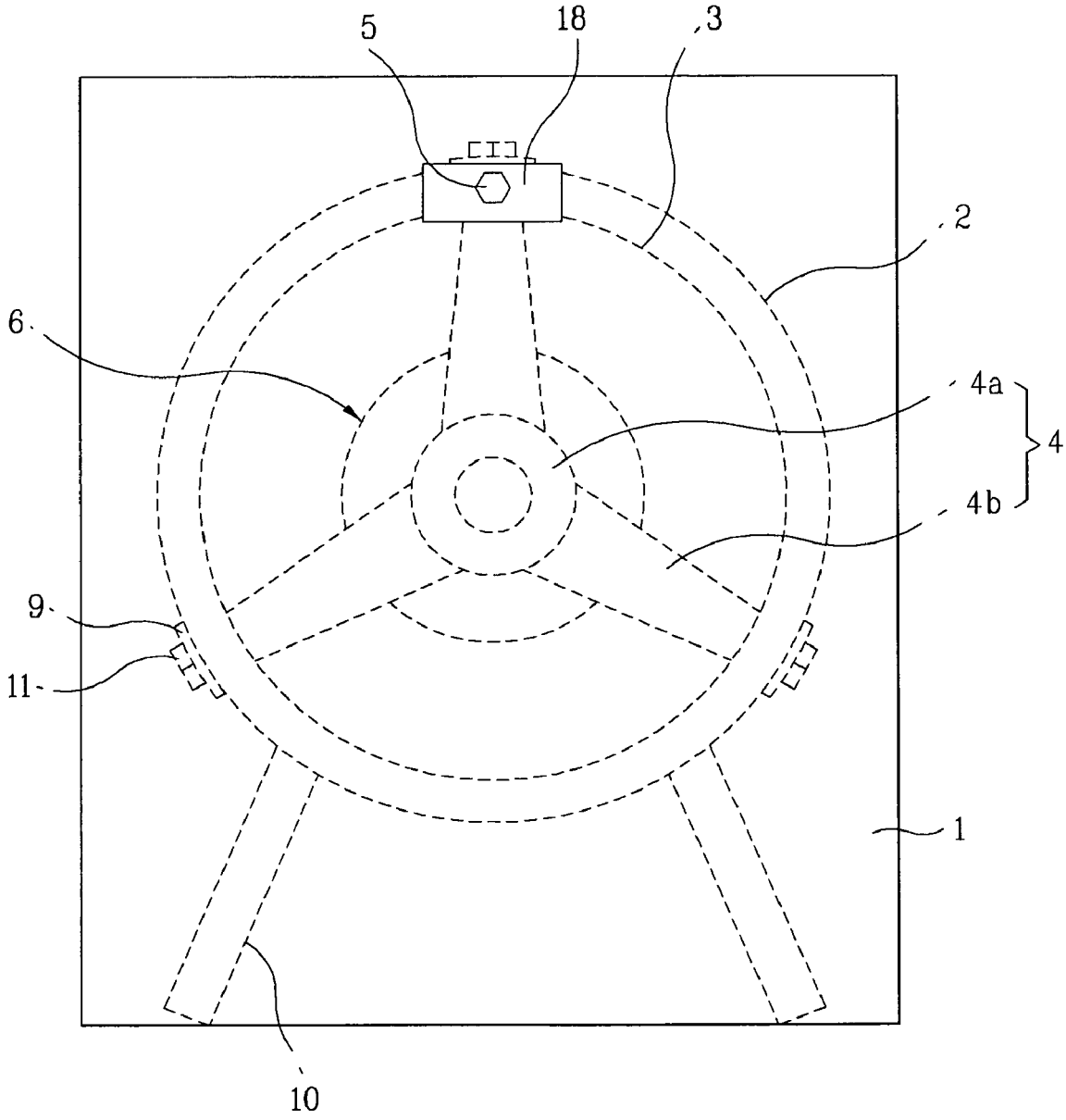
FIG. 4 Related Art
FIG. 4 illustrates a rear view of a drum-type washing machine in accordance with a related art.
Figure 5:
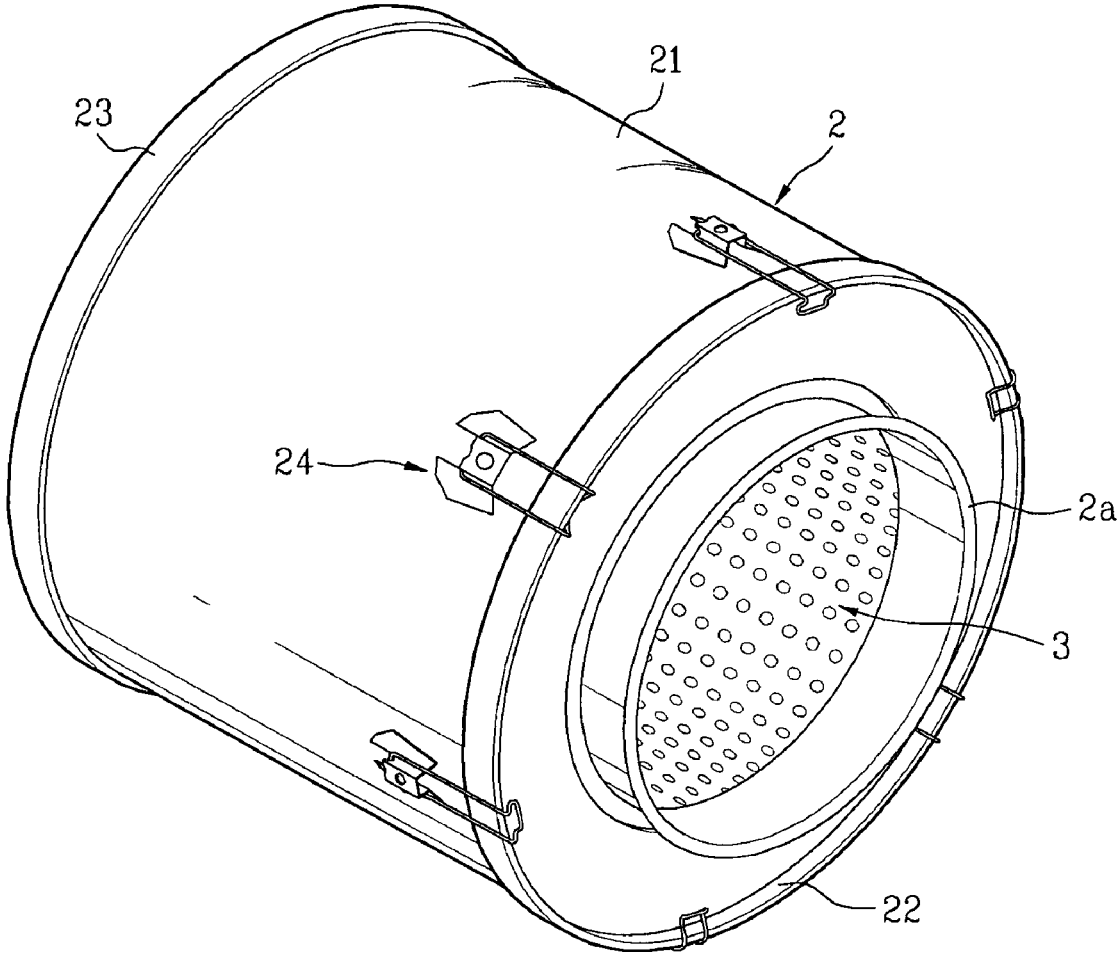
FIG. 5 Related Art
FIG. 5 illustrates a perspective view of a tub in accordance with a related art.
Figure 6:
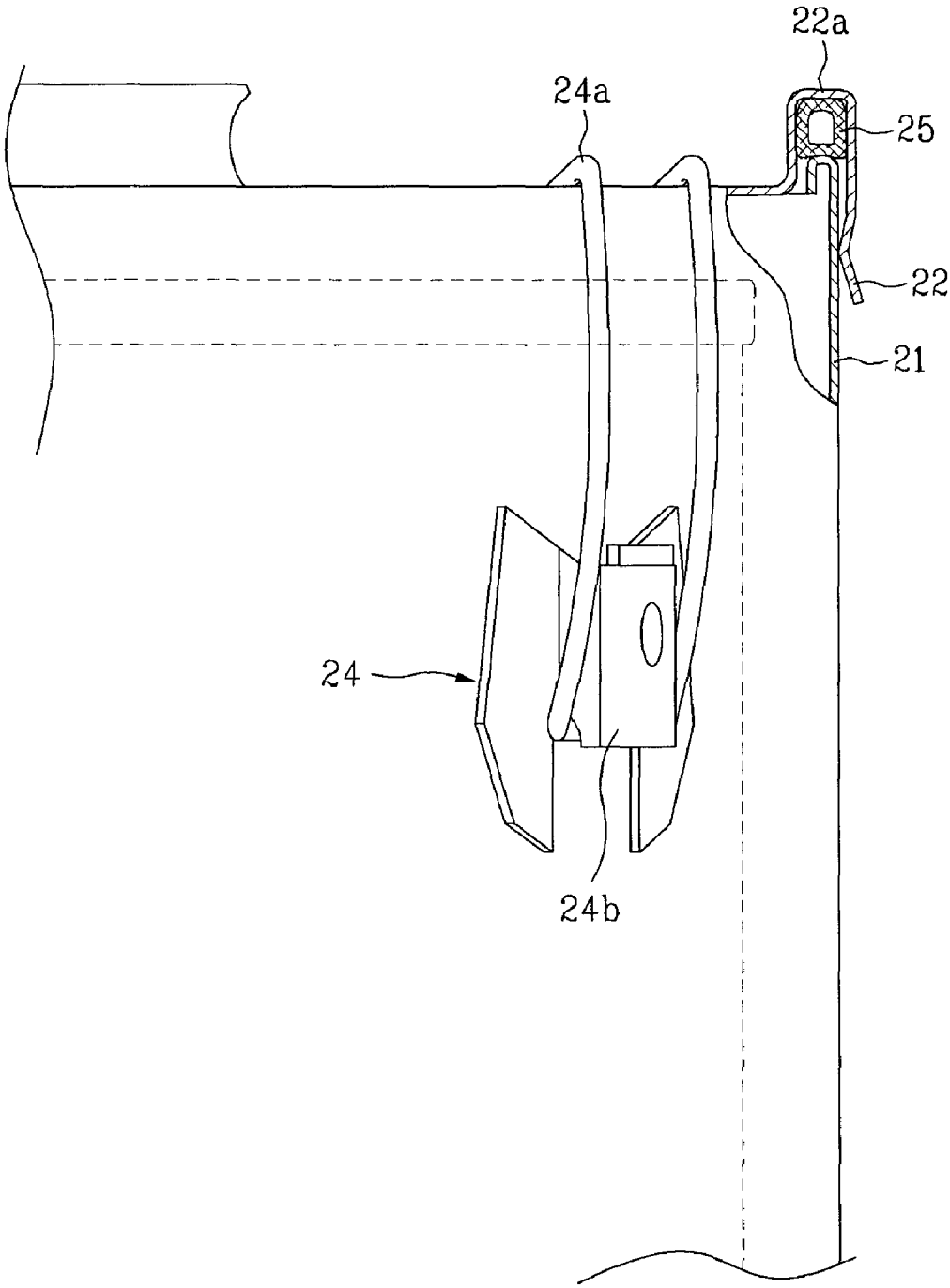
FIG. 6 Related Art
FIG. 6 illustrates a perspective view showing a fixing apparatus of the tub in accordance with a related art.
Figure 7:
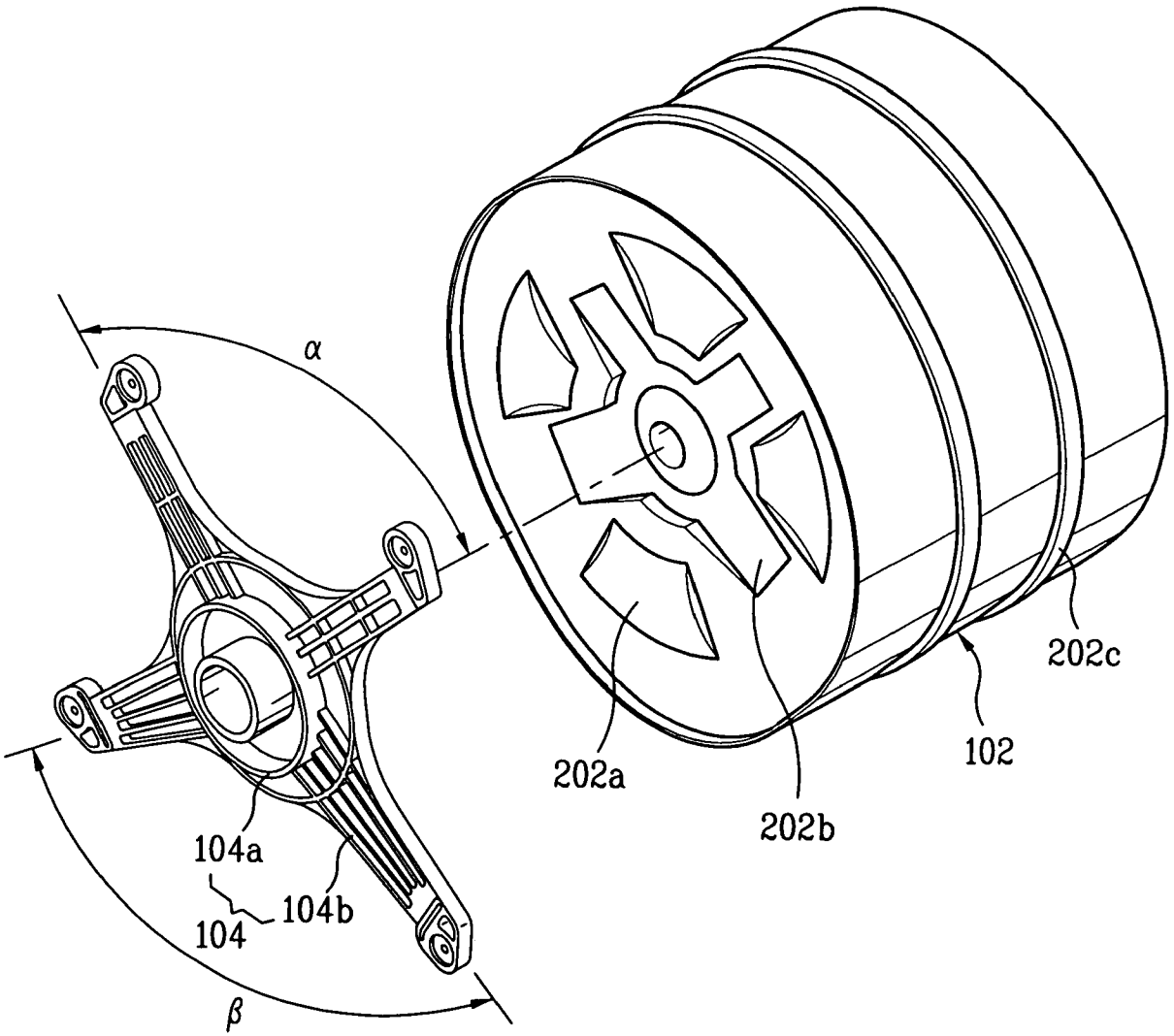
FIG. 7 illustrates a perspective view showing an installed structure of a bearing housing in accordance with the present invention.
Figure 8:
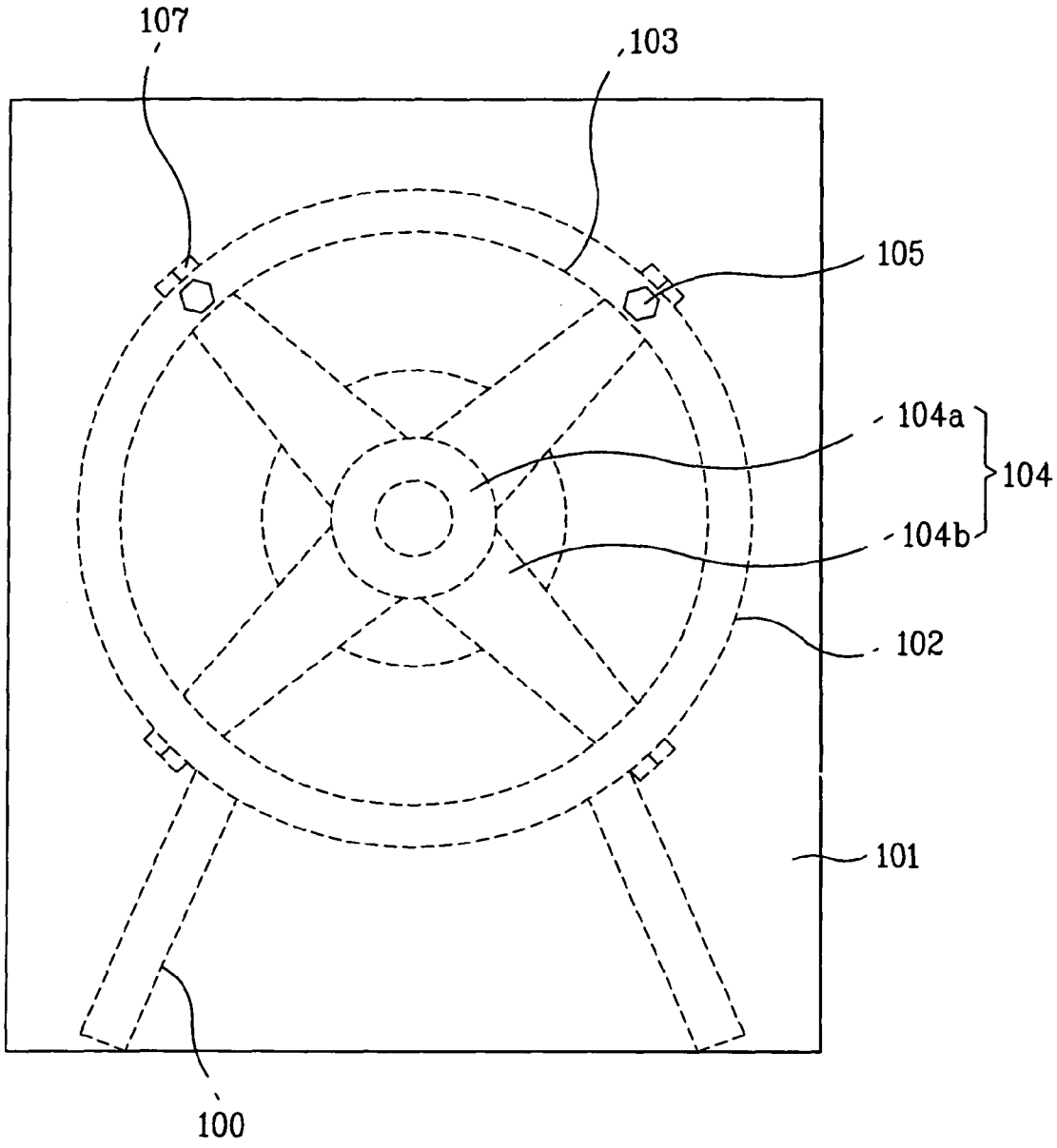
FIG. 8 illustrates a rear view of a drum-type washing machine in accordance with the present invention.

FIG. 7 illustrates a perspective view showing an installed structure of a bearing housing in accordance with the present invention, and FIG. 8 illustrates a rear view of a drum-type washing machine in accordance with the present invention.

As illustrated in FIG. 7, the bearing housing is provided at a rear side of the tub 102 in accordance with the present invention. In this case, a hub 104*a* formed in a cylindrical form is provided on a central part of the bearing housing 104, and four bridges 104*b* are provided along a circumference of the hub 104*a* at predetermined intervals. An end of the bridges 104*b* is fixed to a rear side of the tub 102 by a bolt coupler.

In this case, because weight loaded on the tub 102 is dispersed through four points, the bearing housing 104 is stably fixed to the tub 102 during a high-speed rotation of the drum 103. Because the weight loaded on the bridge 104*b* is dispersed, the tub 102 and the bearing housing 104 are prevented from being damaged.

As illustrated in FIG. 8, it is desirable that the bridges 104*b* are provided to be symmetrical about a perpendicular surface thereof. In this case, coupling holes are provided at two bridges located on an upper part thereof, and carrying bolts 105 are coupled with the coupling holes.

In this instance, since the weight loaded on the carrying bolt 105 is dispersed to two places, the outer case 1 is prevented from being bent. Therefore, there is no need to provide a separate supplementary member at the bolt coupler.

As illustrated in FIG. 7, for supplementing strength of a rear side of the tub 102, first beads 202*a* projected toward a rear side of the tub 102 are provided at four places in spaces between the bridges 104*b*. The first beads 202*a* are projected toward the rear side of the tub 102 by press manufacturing.

In this case, it is desirable that capacity of the drum 103 into which laundry is inserted is increased, and capacity of the tub 102 for storing wash water is decreased. Therefore, the wash water as well as required power that is unnecessary is decreased at the same time because the capacity of tub having the first beads 202*a* is decreased.

Second beads 202*b* whereto the hub 104*a* and the bridge 104*b* are loaded is provided between the first beads 202*a*. The second beads 202*b* depressed toward a front side of the tub 102 supplements the strength of the rear side of the tub 102, and provides a space for loading the hub 104*a* and the bridges 104*b*.

Along the outer circumferential surface of the tub, third beads 202*c* depressed by the press manufacturing are provided. It is desirable that the third beads 202*c* are provided to at least two places spaced apart from each other along an axis direction.

Meanwhile, a lower part of the rear side of the tub 102 may be formed in an oval form for securing a space for a heater. In this case, the heater is provided for heating the wash water for performing a boiling washing in the tub 102.

When the lower part of the rear side of the tub 102 is formed in the oval form, it is desirable that an angle ($\alpha$) between upper bridges is different from an angle ($\beta$) between lower bridges. In this case, the angle ($\beta$) between lower bridges is larger that the angle ($\alpha$) between upper bridges because an area of the lower part of the tub 102 is larger than that of the upper part thereof. In this instance, the two upper bridges 104*b* having the carrying bolt coupled thereto are provided at a symmetrical location. Since the lower part of the first beads 202*a* is formed in the oval form, the upper bead and the lower bead are different in area.

Figure 9:
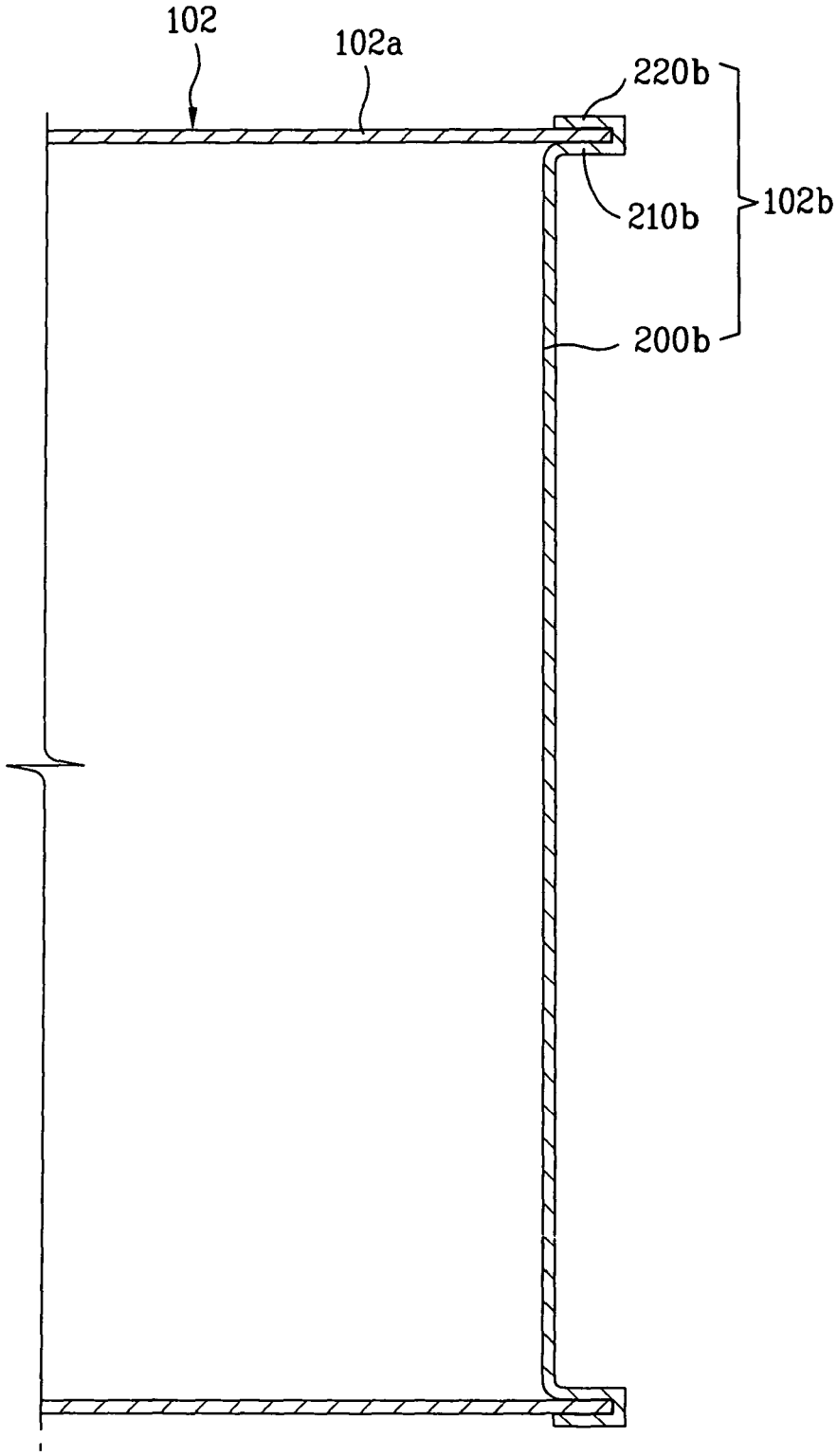
FIG. 9 illustrates a rear cross-sectional view of a tub in accordance with the present invention.
Figure 10:
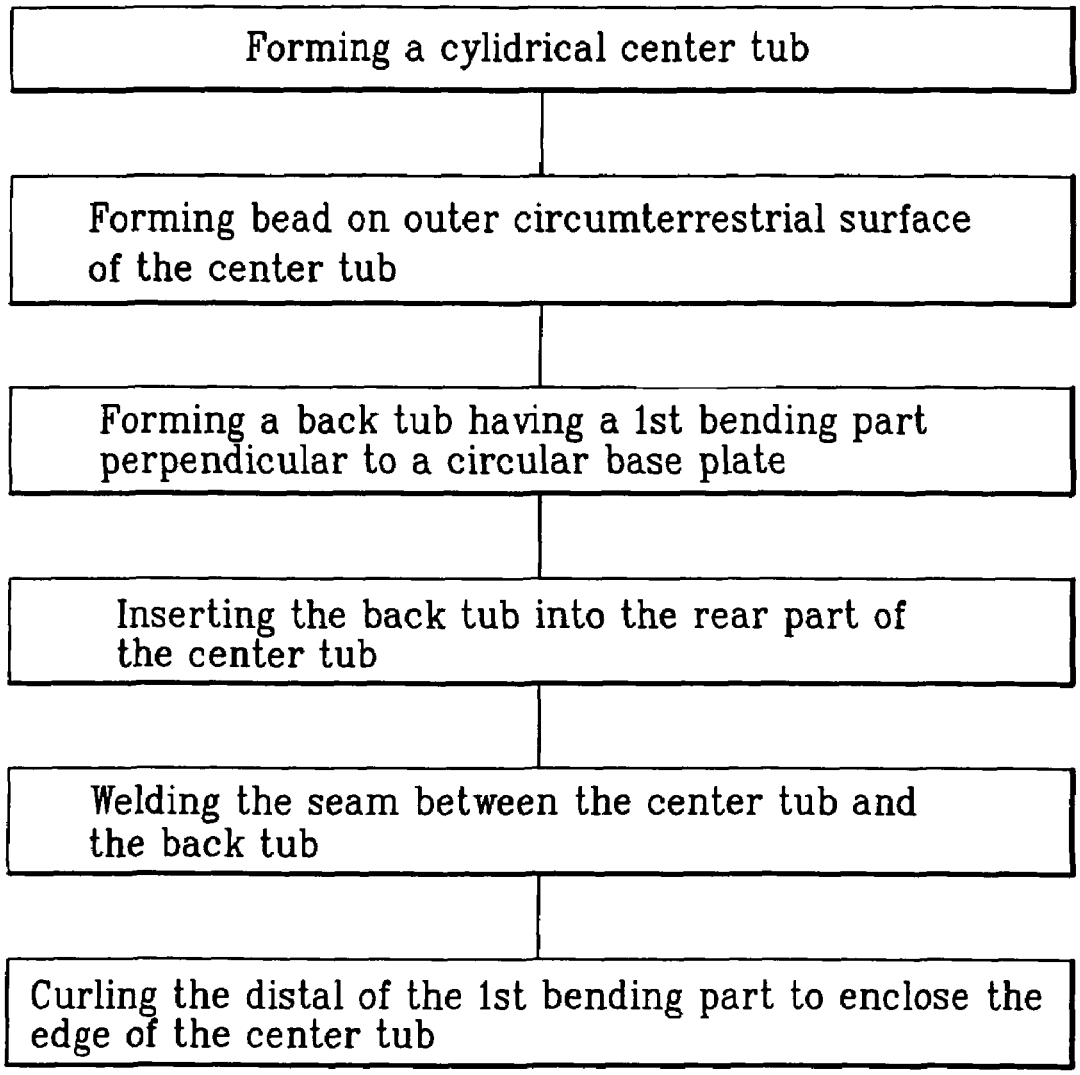
FIG. 10 illustrates a flow chart showing a fabricating method of a tub in accordance with the present invention.

FIG. 9 illustrates a rear cross-sectional view of a tub in accordance with the present invention, and FIG. 10 illustrates a flow chart showing a fabricating method of a tub in accordance with the present invention. As illustrated in FIG. 9, the tub 102 includes a center tub 102*a* formed in the cylindrical form, and a back tub 102*b* covering the rear side of the center tub 102*a*. The back tub 102*b* includes a base plate 200*b*, a first bending part 210*b*, and a second bending part 220*b*.

The first bending part 210*b* is a part bent rearward of the tub 102 from an outline of the base plate 200*b*, and the second bending part 220*b* is a part bent frontward of the tub 102 from the first bending part 210*b*. A rear end of the center tub 102*a* is located between the first bending part 210*b* and the second bending part 220*b*. In this case, a contact part of the back tub 102*b* and the center tub 102*a* is coupled by seam welding.

Referring to FIG. 10, the manufacturing method of the tub in accordance with the present invention will be described as follows.

First, a sheet made of metallic material is rolled, and a seam is welded so as to form the center tub 102*a*. The first bending part 210*b* is provided at the outline of the circular base plate 200*b* by curl manufacturing. Then, the rear end of the center tub 102*a* is inserted along the outer circumferential surface of the first bending part 21*b*.

An overlapping part of the back tub 102*b* and the center tub 102*a* is coupled by seam welding. In more detail, it is desirable that the seam welding is carried out to the seam of the first bending part 210*b* and the center tub 102*a*.

In this case, a thickness of a coupling part of an end of the center tub 102*a* and the bending parts 210*b* and 220*b* is twice larger that that of other parts.

The second bending part 210*b* is formed by bending an end of the first bending part 210*b* by means of curl manufacturing. In this case, a sharp rear end of the center tub 102*a* is covered by the second bending part 220*b* so as to prevent a worker from being injured during transportation or operation.

Owing to a formation of the second bending part 220*b*, the thickness of the coupling part becomes three times larger than that of other parts, thereby increasing strength thereof. Therefore, the coupling part has enough strength for supporting the bearing housing 104.

Contrary to the abovementioned description, the center tub 102*a* may be bent twice by the curl manufacturing, and the end of the back tub 102*b* is covered by the bent part of the center tub 102*a*.

Figure 11A:
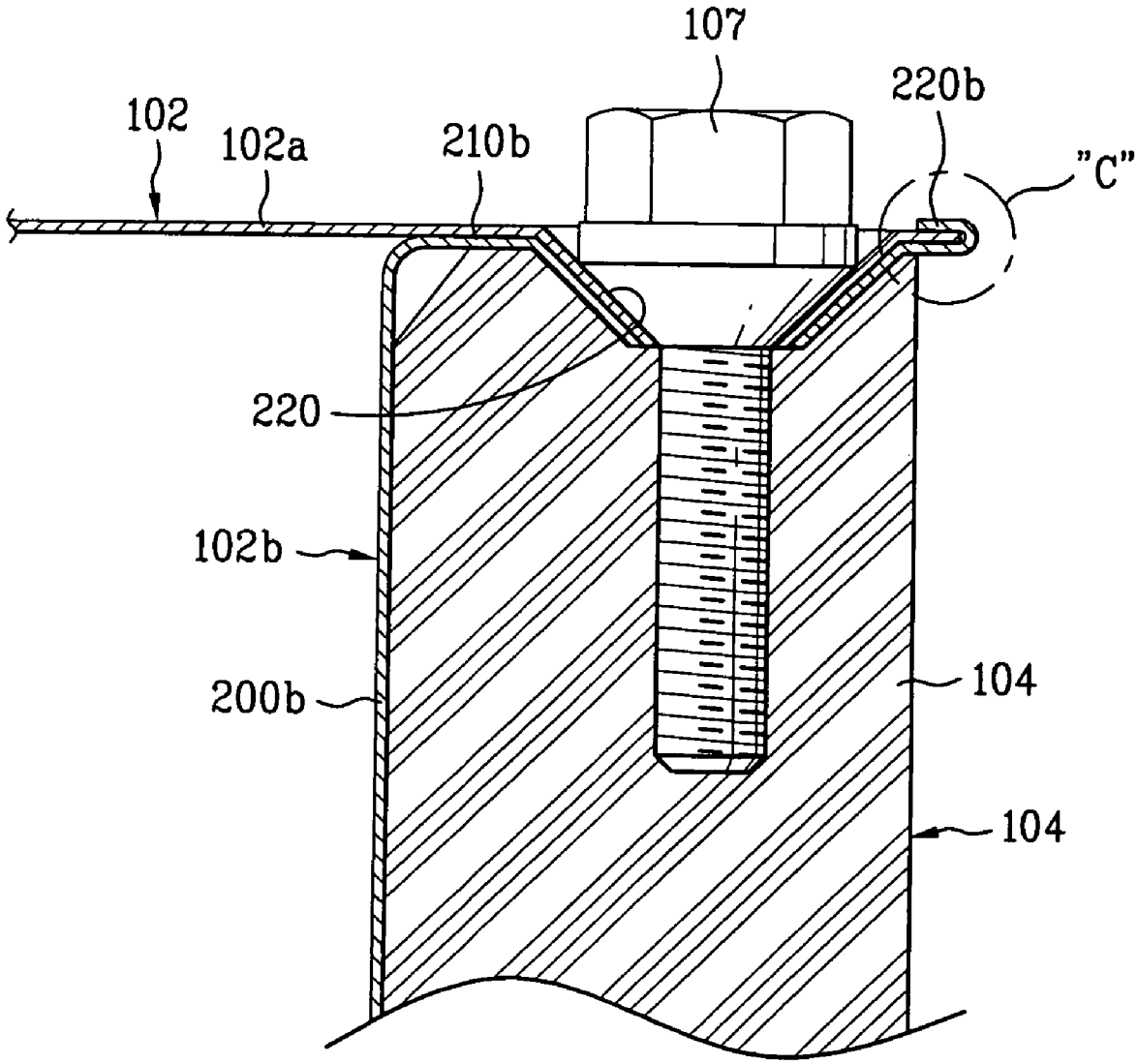
FIGS. 11*a* and 11*b* illustrate a cross-sectional view showing a coupling structure of a tub and a bearing housing in accordance with the present invention.
Figure 11B:
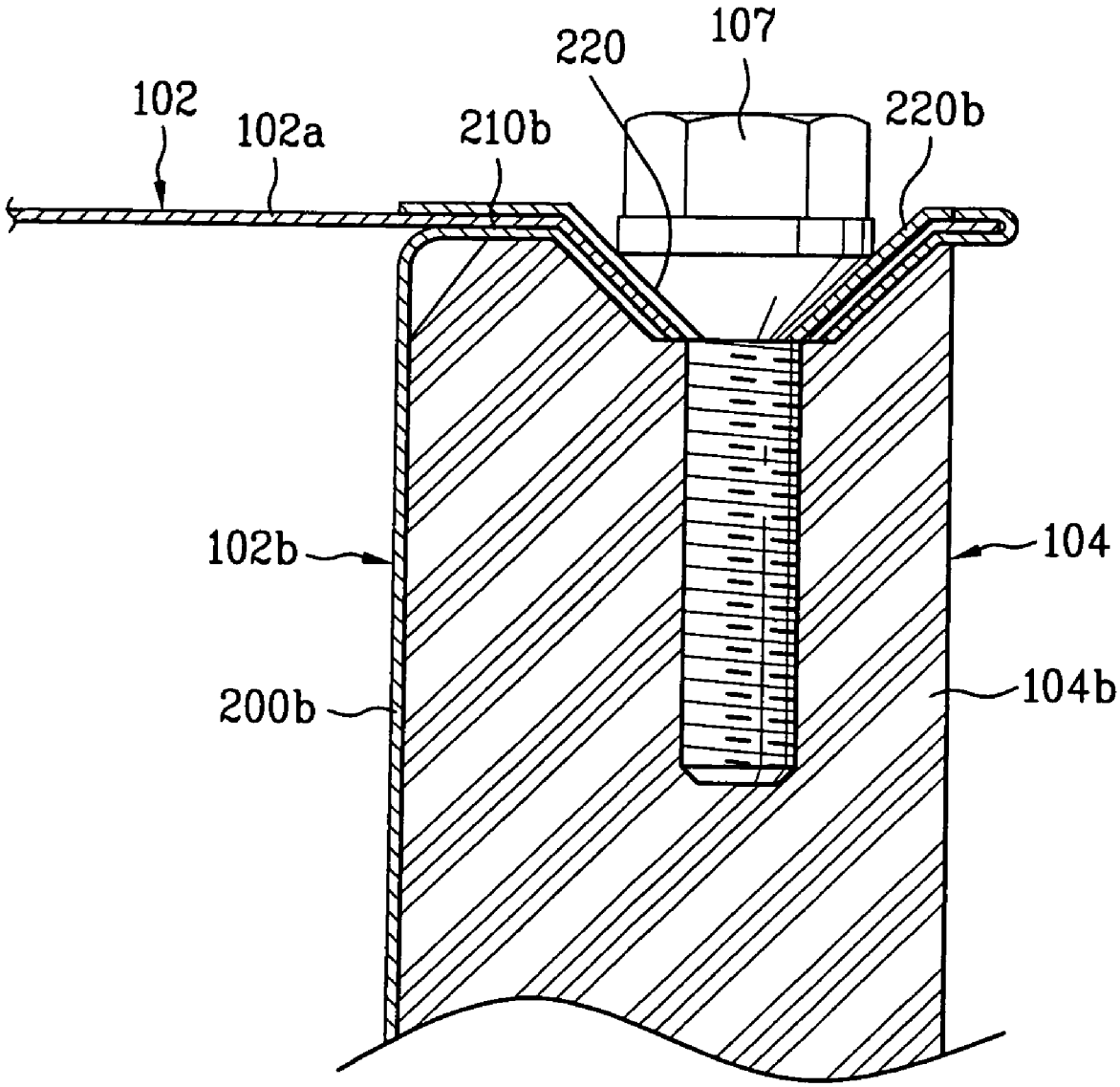

FIG. 11*a* illustrates a cross-sectional view showing a coupling structure of the tub and the bearing housing in accordance with a preferred embodiment of the present invention, and FIG. 11*b* illustrates a cross-sectional view of a coupling structure in accordance with another preferred embodiment of the present invention.

As illustrated in FIG. 11*a*, a pass through hole is provided at a part on which the center tub 102*a* and the first bending part 210*b* are overlapped according to the first embodiment of the present invention. A pass thorough hole is provided at the overlapped part of the center tub 102*a* and the first bending part 210*b* according to the first preferred embodiment. The pass through hole is provided at a location corresponding to the end of the bridges 104*b* of the bearing housing 104, and a guiding surface 220 depressed in the form of "V" by press manufacturing is formed in the vicinity of the pass through hole.

Therefore, because a contact area between the guiding surface 220 formed in "V" form and a lower part of the bolt 107 head is increased, the bolt 107 is prevented from being loosen by the vibration generated from the motor and the drum.

The second bending part 220*b* formed by the curl manufacturing covers the end of the center tub 102*a* at the first bending part 210*b*. In this instance, the second bending part 220*b* is formed to be very short, thereby avoiding contact with the holes which is coupled with the bolt 107.

Meanwhile, according to another embodiment of coupling structure of the bearing housing 104 and the tub 102, the second bending part 220*b* is extended long enough to cover the coupling holes formed at the bridge 104*b*, and the pass through hole through which the bolt 197 passes is provided at the extended portion.

As shown in FIG. 11*b*, the outline of the back tub 102*b* is formed by two times of curl manufacturing at the first bending part 210*b* and the second bending part 220*b*. A rear end of the center tub 102*a* is located between the first bending part 210*b* and the second bending part 220*b*.

The pass through hole passing the second bending part 220*b*, the center tub 102*a*, and the first bending part 210*b* is three times thicker than other parts. The guiding surface 220 depressed in the form of "V" is provided in the vicinity of the pass through hole, and the colt 107 is coupled with the coupling hole formed at the bridge 104*b* through the pass through hole. Therefore, the bearing housing 104 is more stably fixed to the rear part of the tub 102. Since the end of the center tub 102*a* is covered by the second bending part 220*b*, operational safety during assembling is improved.

Meanwhile, the structure of the front side of the tub in accordance with the present invention is described as follows.

Figure 12:
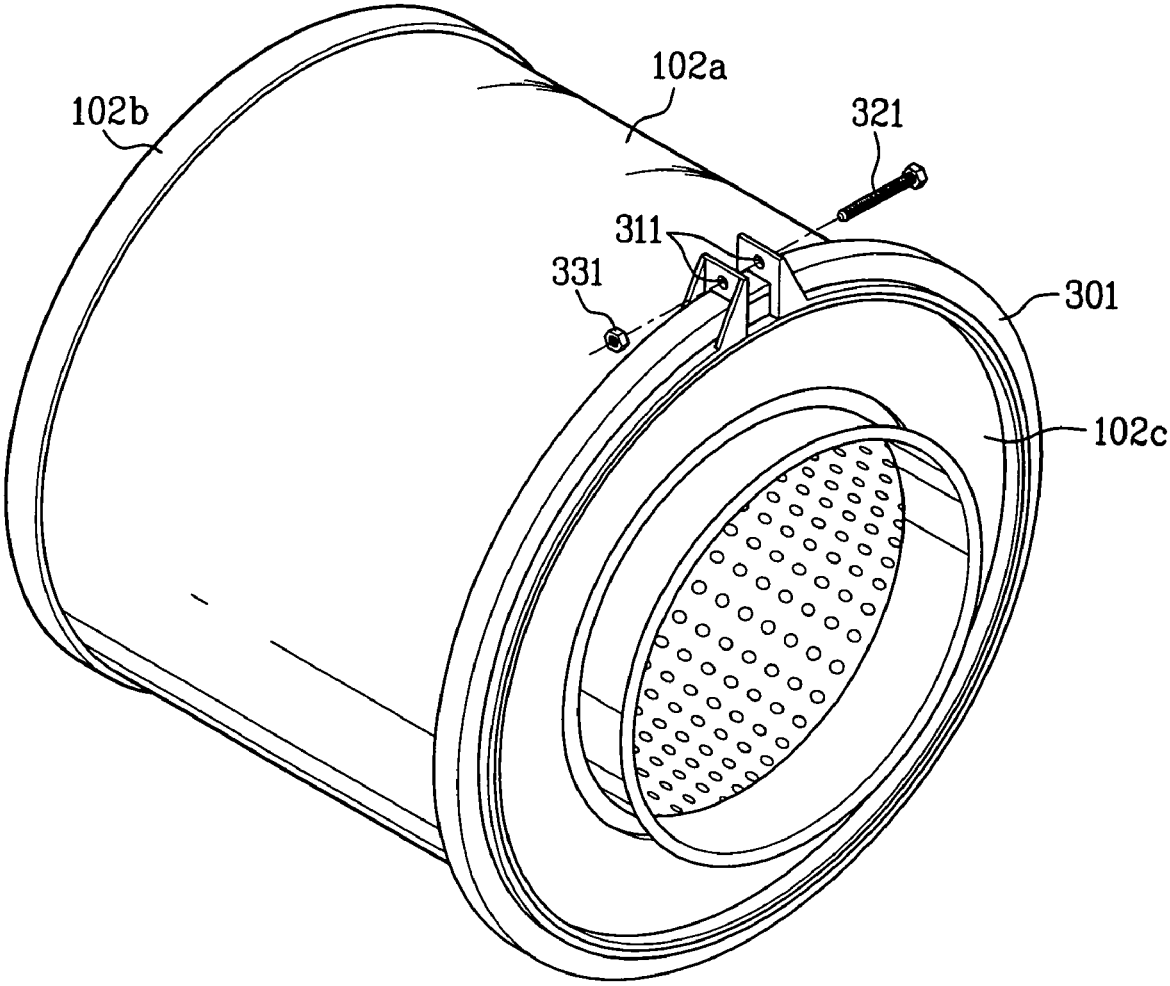
FIG. 12 illustrates a perspective view of a tub in accordance with the present invention.
Figure 13:
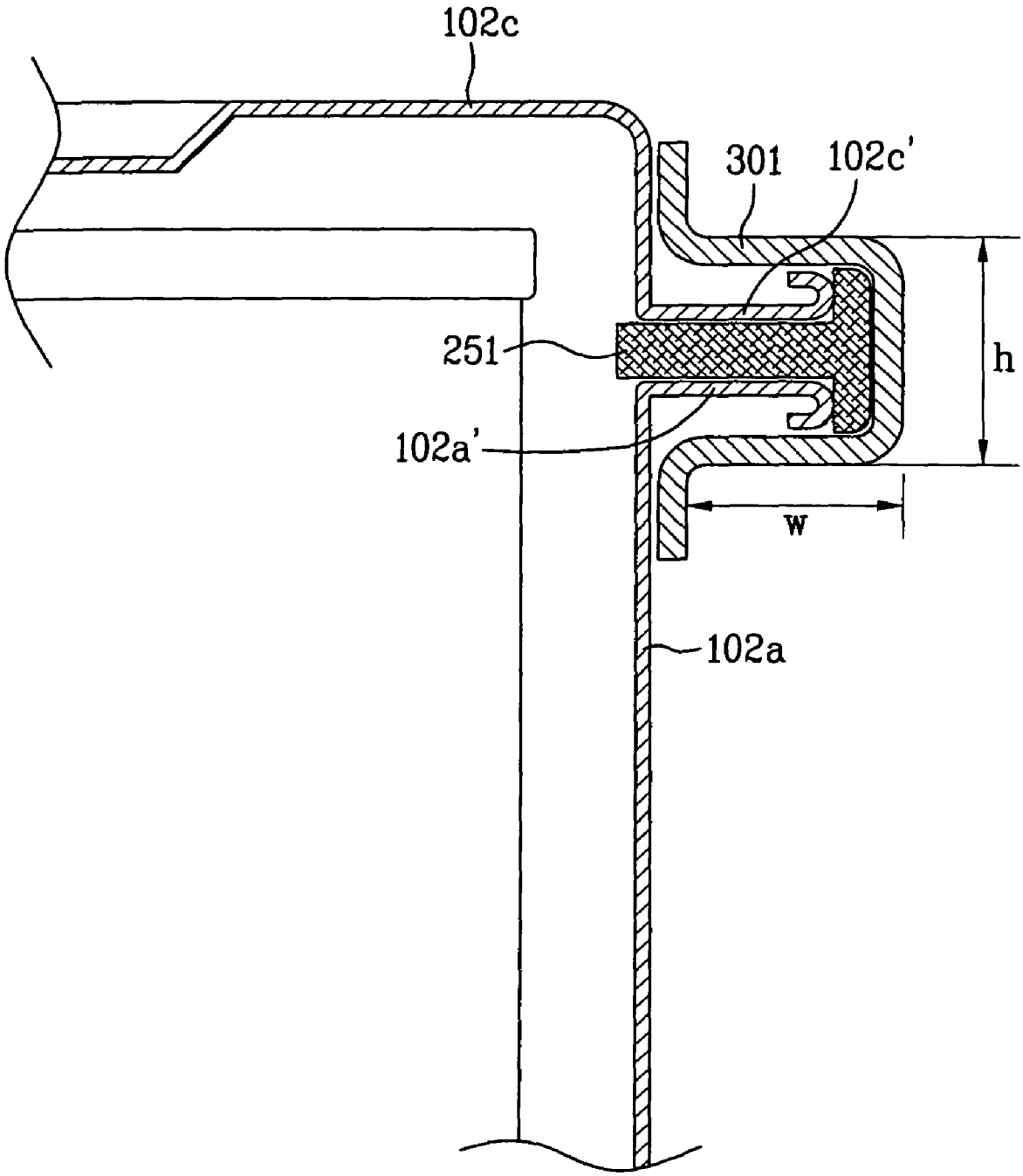
FIGS. 13 and 14 illustrate a cross-sectional view of a coupling structure of a front tub and a center tub in accordance with the present invention.

FIG. 12 illustrates a perspective view of a tub in accordance with the present invention. FIG. 13 illustrates a cross-sectional view showing a coupling structure of the front tub and the center tub in accordance with a first preferred embodiment of the present invention, and 14 illustrates a cross-sectional view showing a coupling structure of a front tub and a center tub in accordance with a second preferred embodiment of the present invention.

As illustrated in FIG. 12, a front tub 102*c* is provided in front of the center tub 102*a*. A third bending part 102*c*' and a fourth bending part 102*a*' bent outward are formed to face each other at outlines of the front tub 102*c* and the center tub 102*a*, and the sealing member 251 is inserted therebetween.

A clamping means is provided along an outer circumferential surface of the third bending part 102*c*' and the fourth bending part 102*a*'. The clamping means couples the front tub 102*c* with the center tub 102*a*, and compresses the sealing member 251 at a time, so as to prevent the wash water from leaking.

In this case, the clamping means includes a bend 301 for covering the outer circumferential surfaces of the third bending part 102*c*' and the fourth bending part 102*a*' so as to compress the sealing member 251.

As illustrated in FIG. 12, the bend 301 is shorter than the length of the outer circumferential surface of the bending parts 102*c*' and 102*a*', and has a part formed in an opened ring form. A tightening means for applying tightening force to the bend 301 in circumferential direction is provided at the opened part.

The tightening means includes a plurality of fixing plates 311, a bolt 321, and a nut 331. In this instance, the plurality of fixing plates 311 is projected from a first part and a second part of the opened part of the bend 301, respectively, to be perpendicular to the circumferential direction.

The bolt 321 is inserted into the holes formed in the fixing plates 311, and the nut 331 applies tightening force to the bend 301 by being coupled with the colt 321. In other words, with more number of the nut 331 being coupled, the tightening force of the bend 301 is intensified.

As illustrated in FIG. 13, in the coupling structure according to the first embodiment of the present invention, a section of the bend 301 is formed in a channel form, and in this case, a section of the sealing member 251 is formed in a "T" form. Therefore, the sealing member 251 is inserted between the bending parts 102*c*' and 102*a*', and then restrained at the end of the bending parts.

The sealing member 251 prevents the wash water from leaking between the bending parts 102*c*' and 102*a*' at first, and between the end of the bending parts 102*c*' and 102*a*' and the bend 301.

The end of the third bend 102*c*' is curled frontward, and the end of the fourth bending part 102*a*' is curled rearward. Therefore, the sealing member 251 is prevented from being scratched by the bending part.

Meanwhile, the bending part and the sealing member are inserted between the bend 301. Then the length of the bend 301 is elongated as the nut 331 is coupled. When the length of the bend 301 is elongated, the height and width of the section is reduced according to Poisson's ratio. The bending parts 102*c*' and 102*a*' and the sealing member 251 are pressured and fixed as the height of the bend 301 is shrunk.

Figure 14:
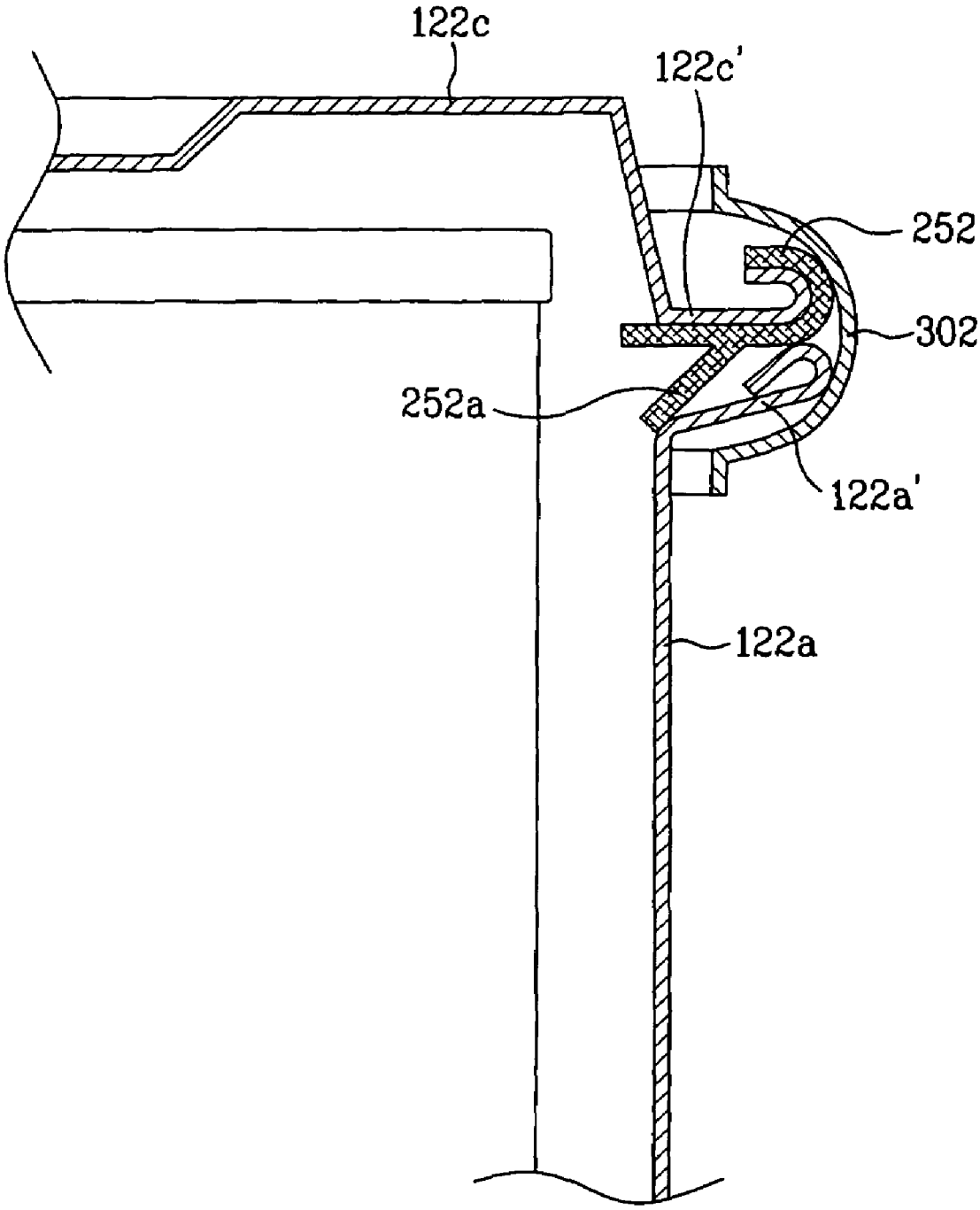

As illustrated in FIG. 14, a section of the bend 302 is formed in a "U" form, and the ends of the third bending part 122*c*' and the fourth bending part 122*a*' are curled frontward.

In this case, the sealing member 252 is provided in "U" form along the third bending part 122*c*'. At a side of the sealing member 252, an extension 252*a* extended to be in contact with the fourth bending part 122*a*' is provided. Therefore, the wash water is prevented from leaking at the extension 252*a* at first, and then at the compressed part of the sealing member 252 and the bend 302.

The aforementioned washing machine in accordance with the present invention has advantages as follows.

First, since the bearing housing is fixed to the tub by four bridges, the vibration and the weight generated during the high speed rotation are dispersed, thereby preventing the tub and the bearing housing from being damaged.

Second, since the carrying bolt is coupled at two places, the weight of the washing machine is dispersed during transportation of the washing machine, thus there is no need to install a separate supplementary member.

Third, since the bending parts are provided on the rear surface of the tub to increase the strength, there is no need to provide separate brackets at the coupling part coupling the bridges of the bearing housing with the tub. Furthermore, since the second bending part covers the sharp rear end of the center tub, the worker is prevented from being injured during transportation.

Fourth, since the guiding surface is provided in the vicinity of the through hole and the coupling hole of the bolt coupled with the bending part, the bolt is stably coupled.

Fifth, since the bend is provided along the outer circumferential surface of the coupling part of the front tub and the center tub, assembling is easy and the coupling force is even along the circumferential direction.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A manufacturing method of a drum-type washing machine, comprising the steps of:

forming a center tub formed in a cylindrical form;

forming beads, formed in a bend form, on an outer circumferential surface of the center tub by compressing with a roller in a state that a press is installed on an inside thereof;

forming a back tub including a first bending part formed by a curl manufacturing on an outline of a base plate formed in a circular form;

inserting the back tub to overlap a rear inner circumferential surface of the center tub with the first bending part;

seam welding the center tub with a side of the first bending part; and forming a second bending part for covering an end of the center tub by curling the first bending part.

2. The drum-type washing machine as claimed in claim 1, wherein the center tub formed in the cylindrical form is formed by rolling a metal sheet into a cylindrical form, and carrying out a butt welding to a seam.

3. The drum-type washing machine as claimed in claim 1, further comprising the step of forming a pass through hole simultaneously passing through the bending parts of the back tub and a rear end of the center tub, and fixing a bearing housing to a rear of the back tub by coupling a bolt to a bridge through the pass through hole.

* * * * *